FIP7811 XR 4,092,045

United States Patent [19]

Sullivan

[11] 4,092,045

[45] May 30, 1978

[54] SUBTERRANEAN HYDRAULIC MINING METHOD

[76] Inventor: Thomas M. Sullivan, 3953 Oregon St., San Diego, Calif. 92104

[21] Appl. No.: 619,787

[22] Filed: Oct. 6, 1975

[51] Int. Cl.[2] ..... E21B 43/26; E21B 43/28; E21C 41/04

[52] U.S. Cl. ..... 299/17; 299/7; 299/13; 299/18

[58] Field of Search ..... 299/4, 7, 13, 16, 17, 299/18, 95; 166/271, 222, 223, 299; 175/4.6

[56] References Cited

U.S. PATENT DOCUMENTS

| | | | |
|---|---|---|---|
| 2,561,639 | 7/1951 | Squires | 299/4 |
| 2,630,182 | 3/1953 | Klotz, Jr. | 166/271 |
| 2,796,129 | 6/1957 | Brandon | 166/271 X |
| 3,393,013 | 7/1968 | Hammer et al. | 299/17 |
| 3,407,003 | 10/1968 | Durie | 166/271 X |
| 3,455,383 | 7/1969 | Prats et al. | 299/4 X |
| 3,498,674 | 3/1970 | Matthews | 299/4 |
| 3,640,579 | 2/1972 | Lewis | 299/4 |
| 3,797,590 | 3/1974 | Archibald et al. | 299/17 X |
| 3,934,935 | 1/1976 | Lambly et al. | 299/16 |

*Primary Examiner*—Stephen J. Novosad
*Attorney, Agent, or Firm*—Brown & Martin

[57] ABSTRACT

A subterranean hydraulic mining system for mining soft sedimentary deposits, such as coal, in which a shaft is sunk through spoil layers, such as sand, dirt, clay, sedimentary deposits, slate, etc., to the sedimentary deposits, such as a coal vein. A second shaft is drilled from the surface to the coal vein in proximity to the first shaft and a small shaped charge is placed down the first shaft and directed toward the termination of the second shaft. A pipeline containing a directive nozzle is then directed down the first shaft with the nozzle oriented toward the second shaft and water and air pumped therethrough. A line is dropped through the second shaft terminating in a hydraulic elevator with water pumped down the shaft and up through the hydraulic elevator. As water is forced through a soft sedimentary deposit from the first shaft to the terminating elevator of the second shaft, it will carry a coal slurry with it which will rise up through the second shaft into a collecting tank where the coal is separated from the water and the water returned to the first and second shafts.

6 Claims, 7 Drawing Figures

SUBTERRANEAN HYDRAULIC MINING METHOD

BRIEF DESCRIPTION OF THE INVENTION

The present invention relates to a subterranean hydraulic mining system and more particularly to a subterranean hydraulic mining system with negligible surface effects.

Because of the ecological disadvantages and objections to strip mining in coal recovery, for example, the present system has been developed which generally involves the sinking of two shafts into a soft sedimentary deposit, such as coal, through the spoil layers which can frequently be one hundred feet or more in depth. Water is pumped down one shaft and forced through the deposits toward the second shaft where it is raised through a hydraulic elevator into a separating tank. The water passing from the first shaft to the second shaft will pick up some of the deposits resulting in a slurry being pumped into the separating tank. The water is then returned to the first and second shafts resulting in a closed hydraulic system. The hydraulic elevator in the second shaft requires water being pumped parallel to the second shaft into the hydraulic elevator. To initiate the process, shaped charges are initially dropped down the first shaft and directed toward the second shaft for creating a small cavity toward the second shaft and cracks in the deposit vein in the vicinity of the first shaft. After that is accomplished an orientable nozzle is dropped down the first shaft and oriented toward the second shaft for more efficient operation. After one area between the shafts has been mined, the equipment is retrieved from the input shaft and the first shaft plugged. A new input shaft is then drilled and the process repeated as will be more apparent with reference to the detailed description below.

An object of the present invention is the provision of a subterranean hydraulic mining system with negligible surface effects.

A further object of the invention is the provision of a subterranean hydraulic mining system which is economical with a minimum of personnel requirements.

Other objects and many of the attendant advantages of the present invention will be readily appreciated as the same becomes better understood by reference to the following detailed description when considered in connection with the drawings, in which like reference numerals designate like parts throughout the Figures thereof and wherein.

DETAILED DESCRIPTION OF THE DRAWING

Figure 1:
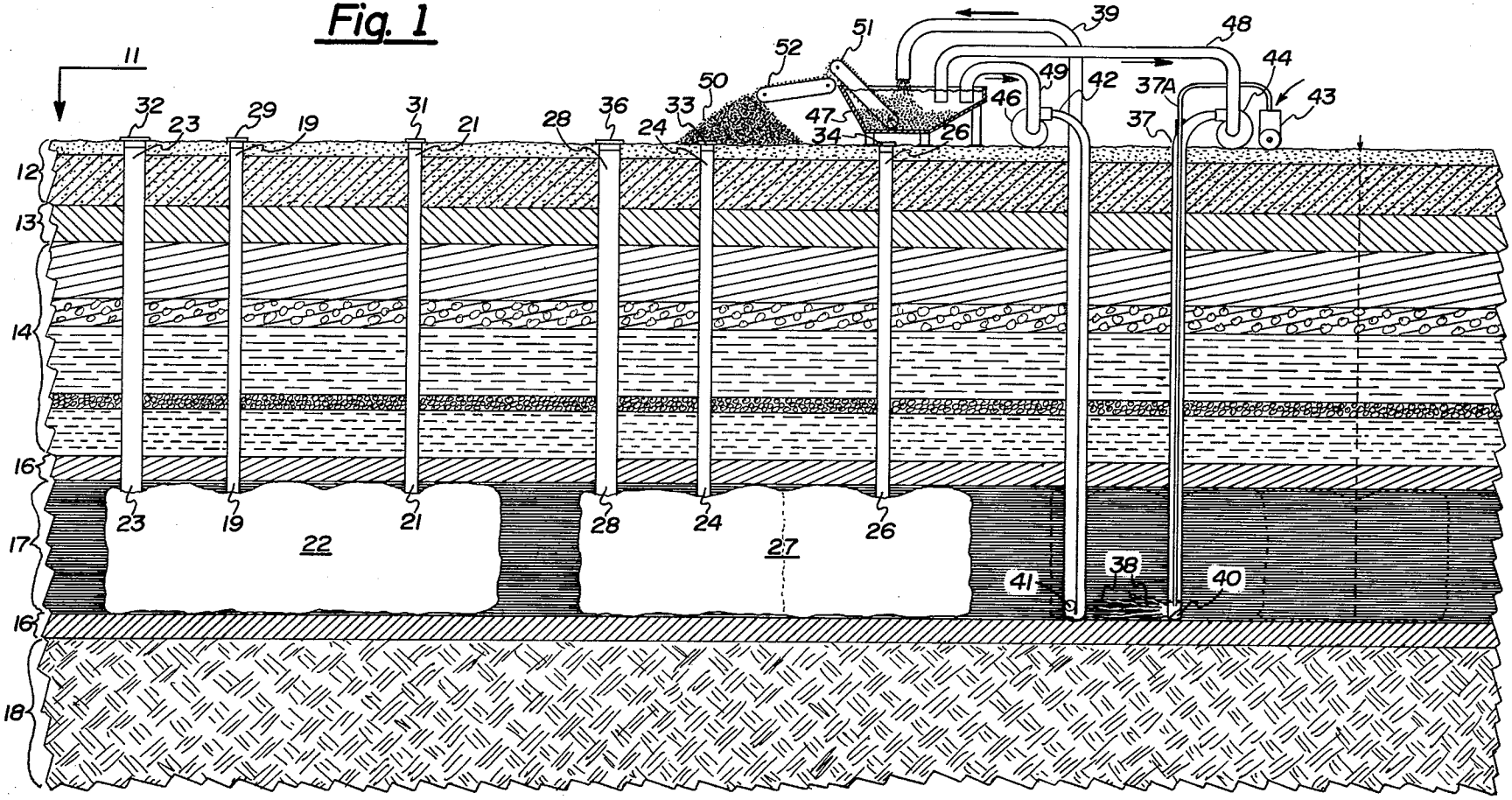
FIG. 1 is a schematic view illustrating the preferred embodiment of the present invention in situ.

Referring to FIG. 1, a spoil layer shown at 11 consists of a sand and dirt layer 12, a clay layer 13, sedimentary deposit layer 14, and slate layer 16. Coal vein 17 is shown between slate layer 16 and a subterranean granite layer 18. Input shafts 19 and 21 communicate with excavated cavity 22. Output shaft 23 also communicates with cavity 22. Input shafts 24 and 26 communicate with excavated cavity 27. Output shaft 28 also communicates with excavated cavity 27. Plugs 29, 31, 32, 33, 34 and 36, plug the surface openings of shafts 19, 21, 23, 24, 26 and 28, respectively.

Input shaft 37 terminates in a nozzle member 40 which communicates with a cracked area of coal deposit 38. Output shaft 39 terminates in a hydraulic lift 41 which also communicates with a cracked area 38 of the coal layer 17. An input line 42 communicates with hydraulic elevator 41. Hydraulic elevator 41 can be a standard Evans type hydraulic elevator. Input shaft 37 has an air line 37A also communicating with nozzle 40. Air line 37A is coupled to a compressor 43 and input line 37 is coupled to the output of a pump 44. Input line 42 to hydraulic elevator 41 is coupled to the output of pump 46 and output line 39 is coupled to separating tank 47. Separating tank 47 has output lines 48 and 49 coupled to the intakes of pumps 44 and 46, respectively. Separating tank 47 has transfer assemblies 51 and 52.

Figure 2:
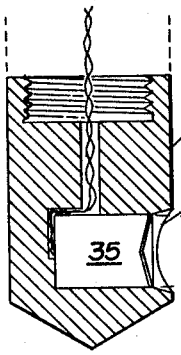
FIGS. 2–4 illustrate shaped charges utilized in the present invention.
Figure 3:
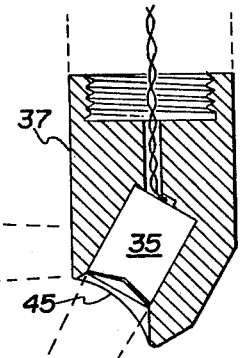
Figure 4:
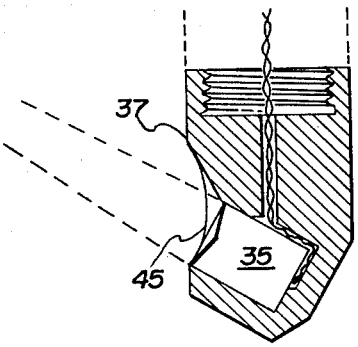

Referring to FIGS. 2–4, input shaft 37 is shown with shaped charge 35 in various orientations through aperture 45.

Figure 5:
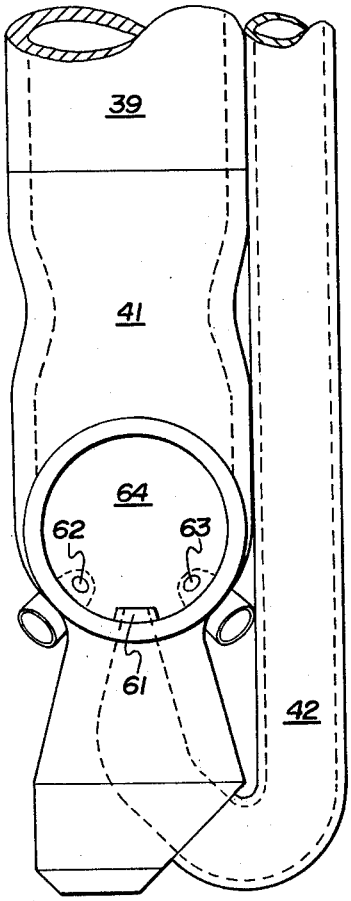
FIG. 5 illustrates a hydraulic elevator utilized in the embodiment of FIG. 1.

Referring to FIG. 5, a typical Evans type hydraulic elevator is shown at 41 having an input line 42 communicating with input orifice 64. Input orifices 62 and 63 also communicate with the area 64 for transfer up through elevator 41 to output line 39.

Figure 6:
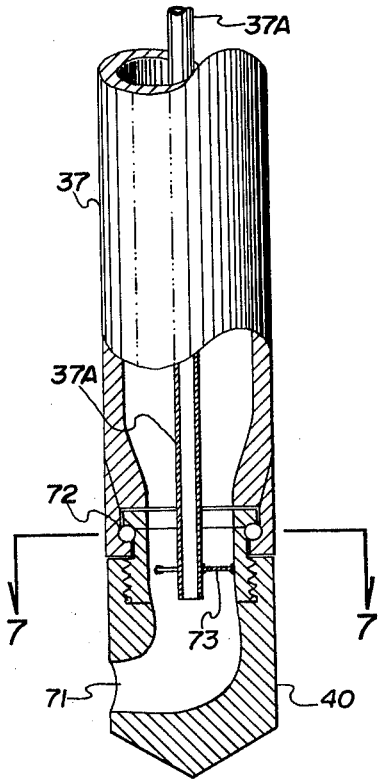
FIG. 6 illustrates a nozzle utilized in the embodiment of FIG. 1.

Referring to FIG. 6, a nozzle member 40 has an orifice 71 and is rotatably coupled to input line 37 through bearing race 72. Air line 37A in coaxial relationship with input line 37 is fixedly attached to spider mount 73.

Figure 7:
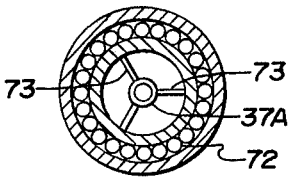
FIG. 7 is a cross sectional view taken along lines 7—7 of FIG. 6.

Referring to FIG. 7, spider mount 73 attached to air line 37A is shown disposed beneath bearing race 72.

OPERATION

Referring to all of the Figures, and particularly to FIG. 1, the operation will be described. Cavity 22 in coal vein 17 is shown in FIG. 1 as the initial starting point of the mining of a subterranean mining operation. Here the first input shaft is shown at 21 in proximity to an output shaft 23. After the area between shafts 21 and 23 has been mined, the equipment from shaft 21 is removed and plug 31 placed at the surface opening. At this time another input shaft 19 is drilled and the area between shaft 19 and 21 is mined throughout shaft 23. When this is completed (naturally, more than two increments is anticipated, depending upon the vein, the depth, etc), the equipment is removed from input shaft 19, and output shaft 23 and surface plugs 29 and 32 placed therein. The equipment is then moved over and input shaft 26 and ouput shaft 28 are drilled to begin the subterranean mining operation in cavity 27. Again, as the initial cavity is excavated an input shaft 24 is drilled further back and shaft 26 plugged at 34, etc. The area between cavity excavations 22 and 27 is left unmined to supply subterranean support.

Referring now to the area shown in operation with input shaft 37 coupled to the output of pump 44, input shaft 37 has an air line 37A concentrically disposed within it and coupled to the output of a compressor 43. Both air line 37A and shaft 37 terminate in a nozzle 40 directed toward a hydraulic elevator 41 at the input of output line 39. An input line 42 supplies water to elevator 41 for the operation thereof and is coupled to the output of pump 46. Output line 39 carries a coal and water slurry to separating tank 47.

At the beginning of the mining operation a shaped charge is placed where nozzle 40 is shown which cracks the coal in the general area between input shaft 37 and output shaft 39. After this, nozzle 40 is put in place and the air and water pumped down through nozzle 40 which will seep through the coal deposits to hydraulic lift 41, carrying with it pieces of coal up through lift 41, output 39, to separating tank 47. As the coal separates in separating tank 47, it is carried through transfer belts 51 and 52 to a pile shown at 50 off the end of transfer belt 52. Water is then carried through line 48 to the input of pump 44 and through line 49 to the input of pump 46 to recirculate the water in the mining operation. Naturally, the entire amount of water will not be recovered and separating tank 47 will be supplied with any deficiency. After the area between nozzle 40 and hydraulic lift 41 has been mined, a second input shaft will be driven to excavate a cavity similar to those shown at 22 and 27.

Referring to FIGS. 2, 3 and 4, shaped charges 35 are shown in various orientations through orifice 45 of input line 37. This, of course, is to initially fragment the coal for initiating the hydraulic mining operation.

Referring to FIG. 5, a typical Evans type hydraulic elevator is shown having an input line 42 up through orifice 61 which carries with it slurry from the input port 64 through output line 39. Input ports 62 and 63 direct the slurry at input port 64 away from the inside wall of lift 41.

Referring to FIGS. 6 and 7, input line 37 is shown with an air line 37A concentrically carried therein and terminating at spider mount 37. The nozzle portion 40 is rotatably coupled to input line 37 via bearing race 72 and hence the orifice orientation 71 can be adjusted through rotational movement of air line 37A at the surface.

It should be understood, of course, that the foregoing disclosure relates to only a preferred embodiment of the invention, and that it is intended to cover all changes and modifications of the example of the invention herein chosen, for the purposes of the disclosure, which do not constitute departures from the spirit and scope of the invention.

The invention claimed is:

1. A method of subterranean hydraulic mining comprising the steps of, drilling an input shaft from the terranian surface into a sedimentary deposit to be mined, drilling an output shaft spaced from the input shaft, from the terranian surface into the sedimentary deposit to be mined, using a shaped charge at the lower end of one of the shafts and cracking the sedimentary deposit generally between the input shaft and the output shaft, forcing a fluid down the input shaft and jetting the fluid at a vertical jetting location into the cracked sedimentary deposit with the fluid carrying portions of the sedimentary deposit to the vicinity of the output shaft, positioning the lower end of the output shaft below the fluid level whereby the fluid and sedimentary deposit move by fluid flow to a receiving opening in the lower end of the output shaft, using a pump in the lower end of the output shaft to move the sedimentary deposit and fluid up the output shaft to the terranian surface, selectively moving the jetting location of jetting of the fluid vertically in the sedimentary deposit while maintaining the lower end of the output shaft at or near the bottom of the opening in the sedimentary deposit cut by the fluid flow from the input shaft, and maintaining a cavity around the output shaft and input shaft that is not filled with liquid.

2. The method claimed in claim 1 including the steps of, forcing water down said input shaft and jetting the water out a side directed nozzle, directing air through a high pressured nozzle in the water stream, whereby the air passes into the water stream aiding in the jet action of the fluid and breaking up the sedimentary deposit, and using the air to fill the cavity cut out by the water flow from the input shaft to the output shaft so that the fluid moving out the jet nozzle passes through an air medium rather than a water medium before striking the sedimentary deposit allowing greater jet water force against the inner surface of the deposit to break up the deposit and wash it down to the end of the output shaft.

3. The method as claimed in claim 1 including the steps of, providing a relatively large opening to the output shaft for passage of relatively large particles of the deposit material, and using a jet pump in moving the water and sedimentary deposit material to the surface through the output shaft.

4. The method claimed in claim 1 including the steps of, washing out the sedimentary deposits in a given cavity in the sedimentary deposit, plugging the holes in which the output and input shafts were located, drilling new input and output shafts from the terranian surface into a sedimentary deposit to be mined at a location adjacent to the given cavity, forcing a fluid down the input shaft into the cracked sedimentary deposit and washing portions of said sedimentary deposit over to the intake of the output shaft, and leaving a wall of sedimentary deposit material between the adjacent cavities to maintain the support of the formation.

5. The method as claimed in claim 1, including the steps of:

directing air down the input shaft and out the lower end of the shaft, and employing the air to fill the cavity cut out by the water flow from the input shaft to the output shaft so that the fluid moving out the jet nozzle passes through an air medium rather than the water medium before striking the sedimentary deposit allowing greater jet fluid force against the inner surface of the deposit to break up the deposit and wash it to the end of the output shaft.

6. The method as claimed in claim 5 including the step of, horizontally rotating the jetting of the fluid at the lower end of the input shaft for directing the fluid stream in all directions through the air medium of the cavity.

* * * * *